US007429188B2

(12) United States Patent
Wu

(10) Patent No.: US 7,429,188 B2
(45) Date of Patent: Sep. 30, 2008

(54) CABLE CONNECTOR ASSEMBLY WITH STATUS INDICATOR MEANS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/481,152

(22) Filed: Jul. 3, 2006

(65) Prior Publication Data

US 2008/0003867 A1 Jan. 3, 2008

(51) Int. Cl.
*H01R 3/00* (2006.01)

(52) U.S. Cl. ..... 439/490

(58) Field of Classification Search ..... 439/488–490, 439/676, 344, 552, 824, 816, 840, 700, 515; 362/555, 800, 640, 311
See application file for complete search history.

(56) References Cited

U.S. PATENT DOCUMENTS 4,712,234 A * 12/1987 Below et al. ..... 379/413.04
5,704,802 A * 1/1998 Loudermilk ..... 439/490
5,885,100 A * 3/1999 Talend et al. ..... 439/490
6,165,006 A * 12/2000 Yeh et al. ..... 439/490
6,174,194 B1 * 1/2001 Bleicher et al. ..... 439/490
6,485,338 B1 * 11/2002 Wu ..... 439/862
6,733,333 B1 5/2004 Chen
6,773,312 B2 8/2004 Bauer et al.
6,814,626 B2 11/2004 Wen-Yao
7,121,707 B2 * 10/2006 Currie et al. ..... 362/555

* cited by examiner

*Primary Examiner*—P. Austin Bradley
*Assistant Examiner*—Edwin A. Leon
(74) *Attorney, Agent, or Firm*—Wei Te Chung

(57) ABSTRACT

A cable connector assembly (100) includes an insulative housing (2) defining a number of receiving passages (23, 24), a number of contacts (3) respectively received in the receiving passages and including at least one detect contact (33), a circuit board (4) assembled to the insulative housing and including an LED (42) connecting with the at least one detect contact, a cable (6) electrically connecting with the circuit board, a rear cover (7) assembled to the housing, and status indicator means (82) molded with the rear cover and overlapping the LED to spread the light emitted by the LED outwardly for normal status indication.

17 Claims, 11 Drawing Sheets

CABLE CONNECTOR ASSEMBLY WITH STATUS INDICATOR MEANS

BACKGROUND OF THE INVENTION

1. Field of the Invention

The present invention generally relates to a cable connector assembly, and more particularly to a cable connector assembly used for power transmission.

2. Description of Related Art

For indicating normal status of a pair of complementary connectors, status indicator means is adopted, preferably mounted in a cable connector assembly. The status indicator means usually comprises an LED equipped on an inner circuit board and electrically connecting with a detect contact of the cable connector assembly, and a member made of transparent or semitransparent material and overlapping with the LED. When the cable connector assembly mates with a complementary connector normally, the detect contact drive the LED to emit light, and then the light can be conducted outwardly through the status indicator means for indication. Such status indicator means may be a cover made of transparent or semitransparent material and assembled at a rear of the cable connector assembly or a cable with transparent or semitransparent outer jacket for light emitting. However, it is costly to make the whole cover or the whole cable of transparent or semitransparent material. With the cost-down trend of the electronics, such high-cost connectors are out of trend.

Thus, a cable connector assembly with status indicator means and low cost is highly desired to address above problems.

BRIEF SUMMARY OF THE INVENTION

Accordingly, an object of the present invention is to provide a cable connector assembly with status indicator means for normal status indication.

In order to achieve the above-mentioned object, a cable connector assembly in accordance with the present invention comprises an insulative housing defining a plurality of receiving passages, a plurality of contacts respectively received in the receiving passages and comprising at least one detect contact, a circuit board assembled to the insulative housing and comprising an LED connecting with the at least one detect contact, a cable electrically connecting with the circuit board, a rear cover assembled to the housing, and status indicator means molded with the rear cover and overlapping the LED to spread the light emitted by the LED outwardly for normal status indication.

Other objects, advantages and novel features of the invention will become more apparent from the following detailed description of the present embodiment when taken in conjunction with the accompanying drawings.

DETAILED DESCRIPTION OF THE INVENTION

Figure 1:
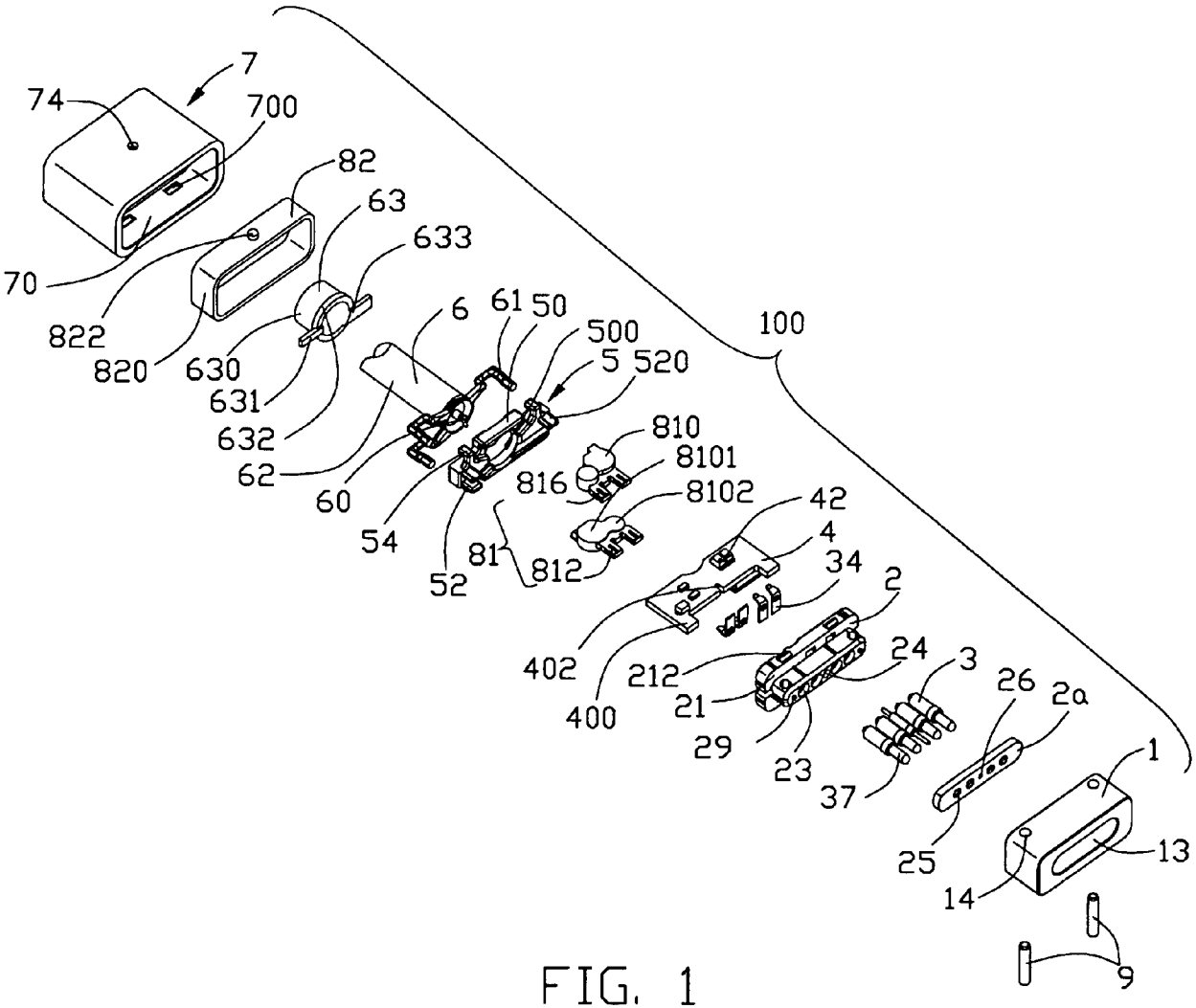
FIG. 1 is an exploded, perspective view of a cable connector assembly in accordance with the present invention.

Reference will now be made to the drawing figures to describe the present invention in detail.

Referring to FIGS. 1-4, a cable connector assembly 100 in accordance with the present invention comprises an insulative housing 2, a plurality of conductive contacts 3 received in the housing 2, a circuit board 4 assembled to the housing 2, a plurality of conductive elements 34 respectively electrically connecting with the contacts 3 and the circuit board 4, a strain relief member 5 assembled to and electrically connecting with the circuit board 4, a cable 6 electrically connecting with the strain relief member 5 to achieve the electrical connection with the circuit board 4, front and rear covers 1, 7 respectively assembled to the housing 2 and together enclosing the elements mentioned above therebetween.

Figure 3:
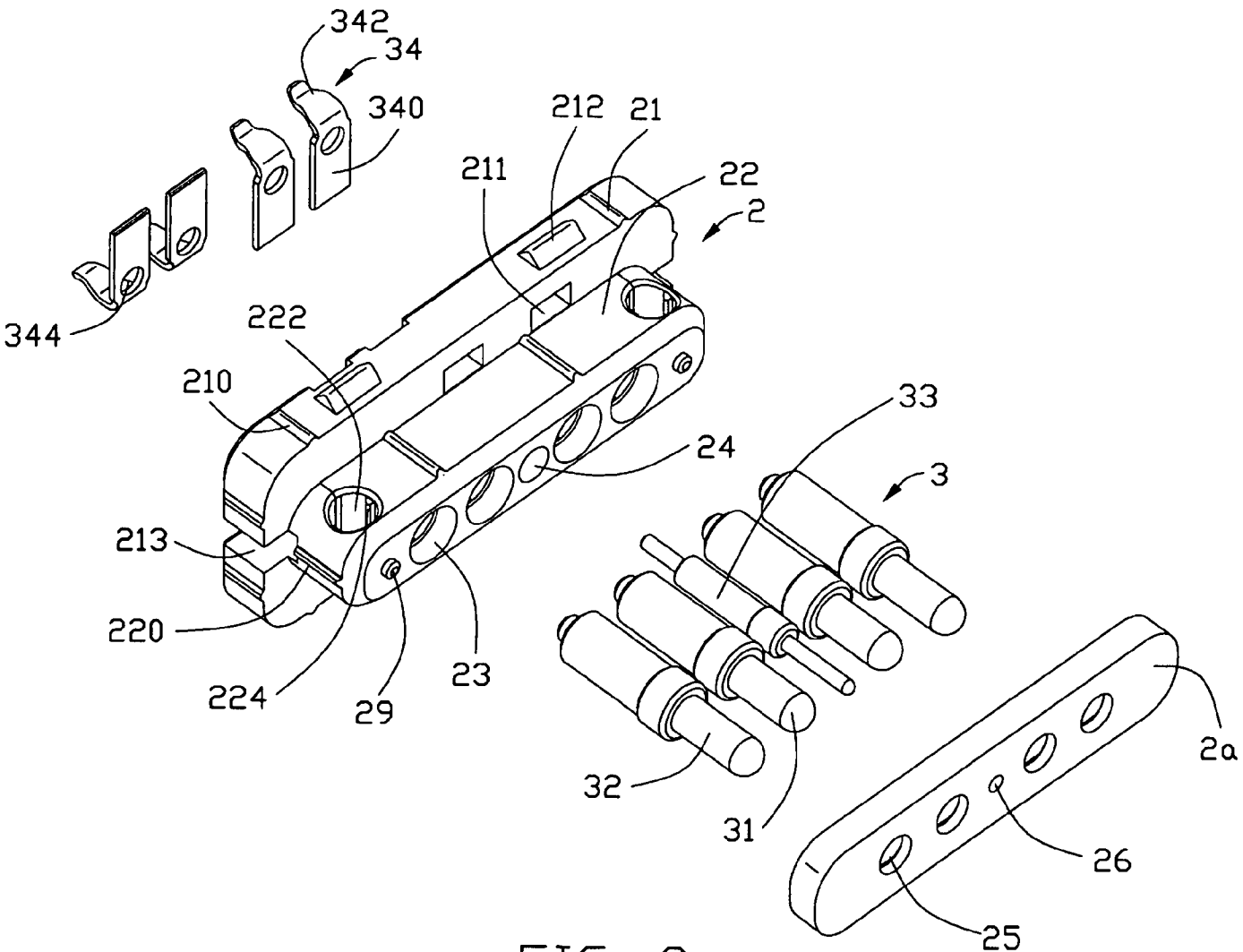
FIG. 3 is a partially enlarged view of FIG. 1.
Figure 4:
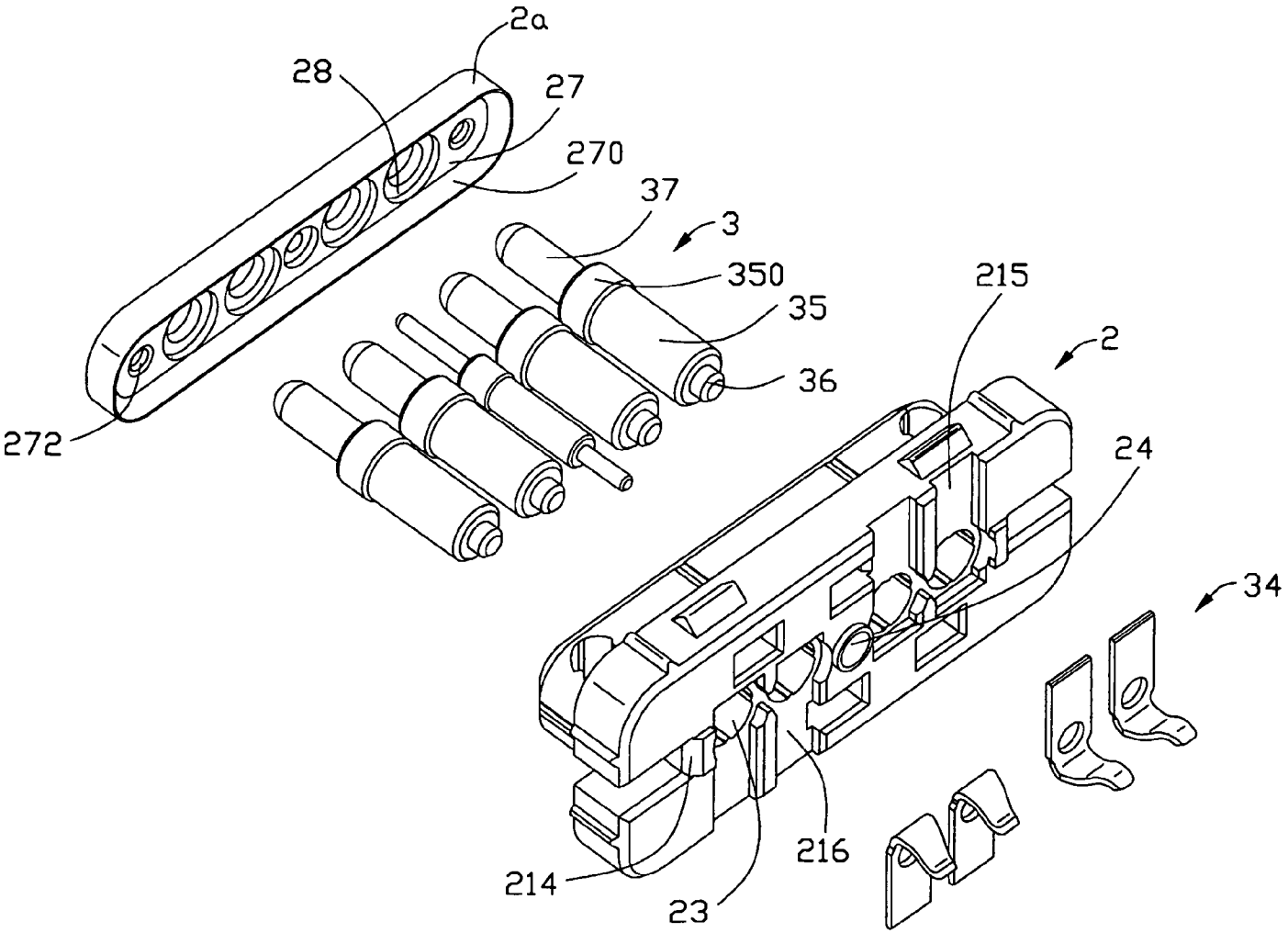
FIG. 4 is a view similar to FIG. 3, but viewed from a different aspect.

Please refer to FIGS. 3-4, the housing 2 comprises a base portion 21 and a tongue portion 22 extending forwardly from the base portion 21. The housing 2 defines two pairs of large-size first receiving passages 23 and a center small-size second receiving passage 24 respectively recessed from a front face of the tongue portion 22 to a rear face of the base portion 21. Each passage 23, 24 is formed with a relatively larger dimension in a front portion thereof and a relatively smaller dimension in remaining portion thereof. The base portion 21 forms a plurality of first friction ribs 210 arranged on outer periphery of the base portion 21 with an interval and extending along a front-to-back direction. A pair of tapered protrusions 212 is respectively formed on each of the upper and lower surfaces of the base portion 21. The base portion 21 defines two pairs of rectangular first slots 211 spaced arranged in upper and lower walls and respectively recessed from the front face to the rear face thereof with determined distance from respective top and bottom surfaces. The base portion 21 also defines a pair of second slots 213 extending along the front-to-back direction to communicate the front face with opposite rear face and recessed inwardly from opposite lateral walls thereof. A pair of tapered protrusions 214 are formed on the rear face of the base portion 21 and locate adjacent to corresponding second slots 213 for facilitating the insertion of the circuit board 4. A pair of first rectangular recesses 215 and a pair of second rectangular recesses 216 with opening toward opposite contrary directions respectively recessed forwardly from the rear face of the base portion 21 and respectively communicating with the first receiving passages 23. The tongue portion 22 defines a pair of circular first engaging holes 222 extending therethrough along up-to-down direction and forms a pair of second friction ribs 220 on opposite lateral walls thereof extending along the front-to-back direction. Each engaging hole 222 forms a pair of ribs 224 protruding outwardly from inner periphery thereof. A pair of positioning posts 29 protrude forwardly from the front surface of the tongue portion 22 and are spaced arranged adjacent to opposite lateral walls of the tongue portion 22.

Now referring to FIGS. 1-4, the conductive contacts 3 consist of a pair of ground contacts 32, a pair of power contacts 31 located between the pair of ground contacts 32 and a center detect contact 33 located between the pair of power contacts 31. Each contact 3 is of a POGO Pin type, that is to say, there is a spring (not shown) inside the contact 3, thus, when mating, the contact 3 can be pressed to rearward move along the mating direction. Each ground contact 32 comprises a column-shape contacting portion 37 with a relatively small diameter, a column-shape media portion 35 with a relatively large diameter, and an end portion 36 formed at rear end of the media portion 35 with a column-shape and smaller diameter. A front engaging section 350 protrudes outwardly from outer periphery of the media portion 35. The power contact 32 has the same structure as that of the ground contact 31 except the contacting portion 37 thereof has a length shorter than that of the ground contact 31. The detect contact 33 has the same structure as that of the power contact 32 except each portion thereof has a smaller diameter than that of the power contact 32. In addition, the end portion 36 of the detect contact 33 is longer than that of the power or ground contacts 31, 32.

Figure 2:
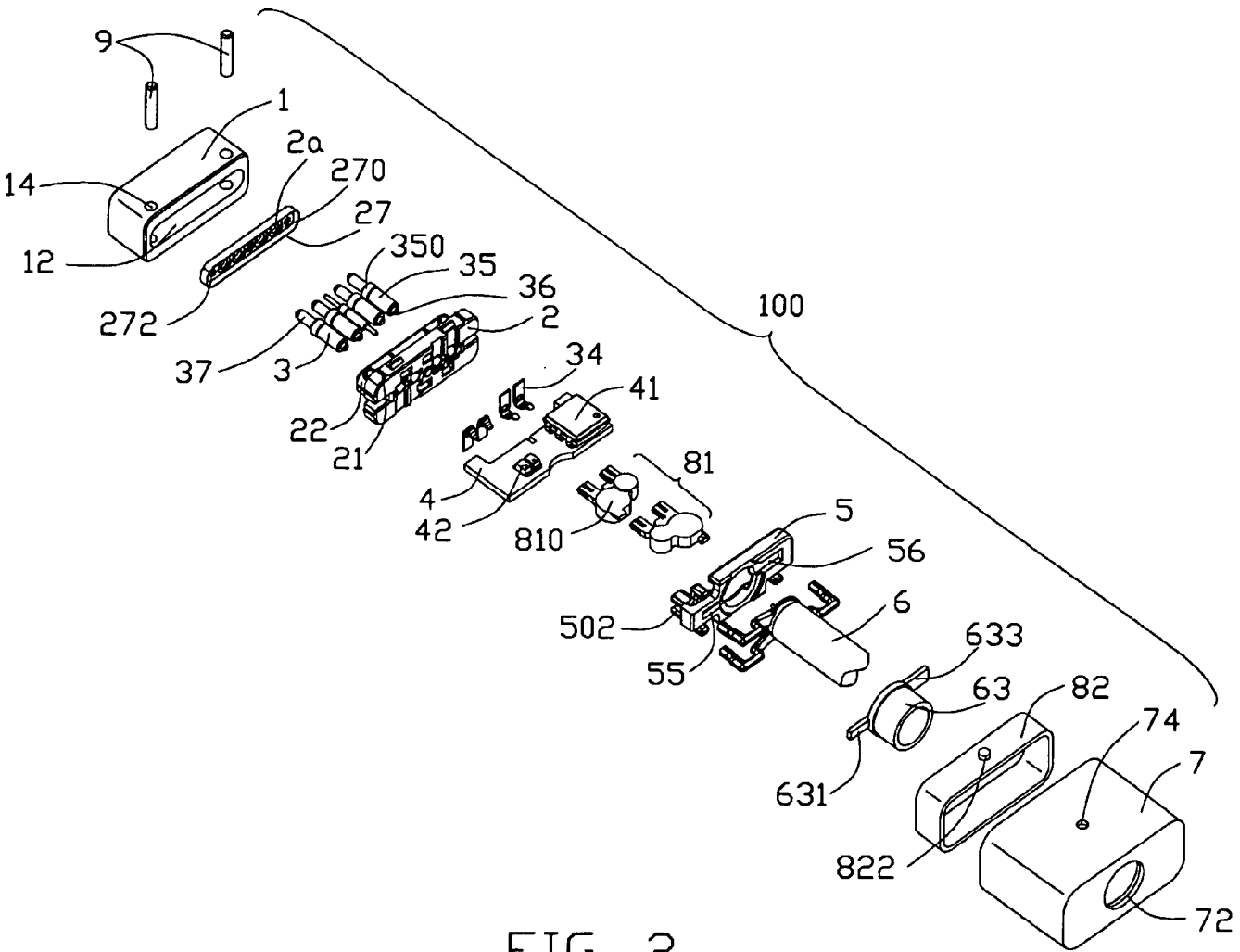
FIG. 2 is a view similar to FIG. 1, but viewed from a different aspect.

Referring to FIGS. 1-3, the conductive elements 34 are divided into two groups respectively oriented in opposite directions. Each conductive element 34 is of L-shape and comprises an upright connecting portion 340 defining a circular receiving opening 344 therein, and a curved tail portion 342 substantially vertically extending from the connecting portion 340.

Referring to FIGS. 1-2, the circuit board 4 comprises a substrate 40 formed with first conductive pads and opposite second conductive pads (not shown), and a pair of LEDs 42 arranged on opposite sides of the substrate 40 and located adjacent to rear edge thereof with non-aligning relationship along vertical direction. The circuit board 4 may be equipped with an IC 41 for driving the LEDs 42 to emit light. The substrate 40 comprises a pair of stretching arms 400 extending forwardly from opposite lateral sides thereof.

The strain relief member 5 is die casted from metal material or other conductive material. The strain relief member 5 comprises a main portion 50 defining a circular through hole 500 in a center thereof. Three corners of the main portion 50 are cutout to form three L-shape cutout areas 502. Three jointing portions 52 respectively forwardly extend from a front surface of the main portion 50 and are respectively located adjacent to both corresponding cutout area 502 and corresponding lateral side of the main portion 50. Three substantially L-shape routing portions 54 firstly vertically extend from bottoms of corresponding cutout areas 502, then flatly extend into the three cutout areas 502. In the vertical direction, each routing portion 54 does not align with corresponding jointing portion 52. Each jointing portion 52 is partially cut to form a curved recess area 520 mainly extending in the front-to-back direction. The strain relief member 5 also defines first and second slots 55, 56 respectively recessed forwardly from the rear surface thereof with different width along the vertical direction and non-aligning relationship along the lateral direction.

The cable 6 comprises an inner conductor 60, a metal braiding layer 61 surrounding the inner conductor 60, and an outer jacket 62 enclosing the metal braiding layer 61. A front portion of the outer jacket 62 is stripped to expose part of the inner conductor 60 and the metal braiding layer 61. In this embodiment, the exposed portion of the metal braiding layer 61 is divided into three parts corresponding to the routing portions 54 and the jointing portions 52 of the strain relief member 5. The cable 6 may be equipped with a stuffing member 63 made from resin material. The stuffing member 63 comprises a circular main portion 630, an enlarged stuff portion 632 formed at front end of the main portion 630, and a pair of first and second orientation portions 631, 633 extending transversely from outer edge of the stuff portion 632 with different widths along the vertical direction. In addition, the first and second orientation portions 631, 633 are arranged with unsymmetrical relationship with the first orientation portion 631 locating at an upper position than the second orientation portion 633 along the vertical direction.

Figure 8:
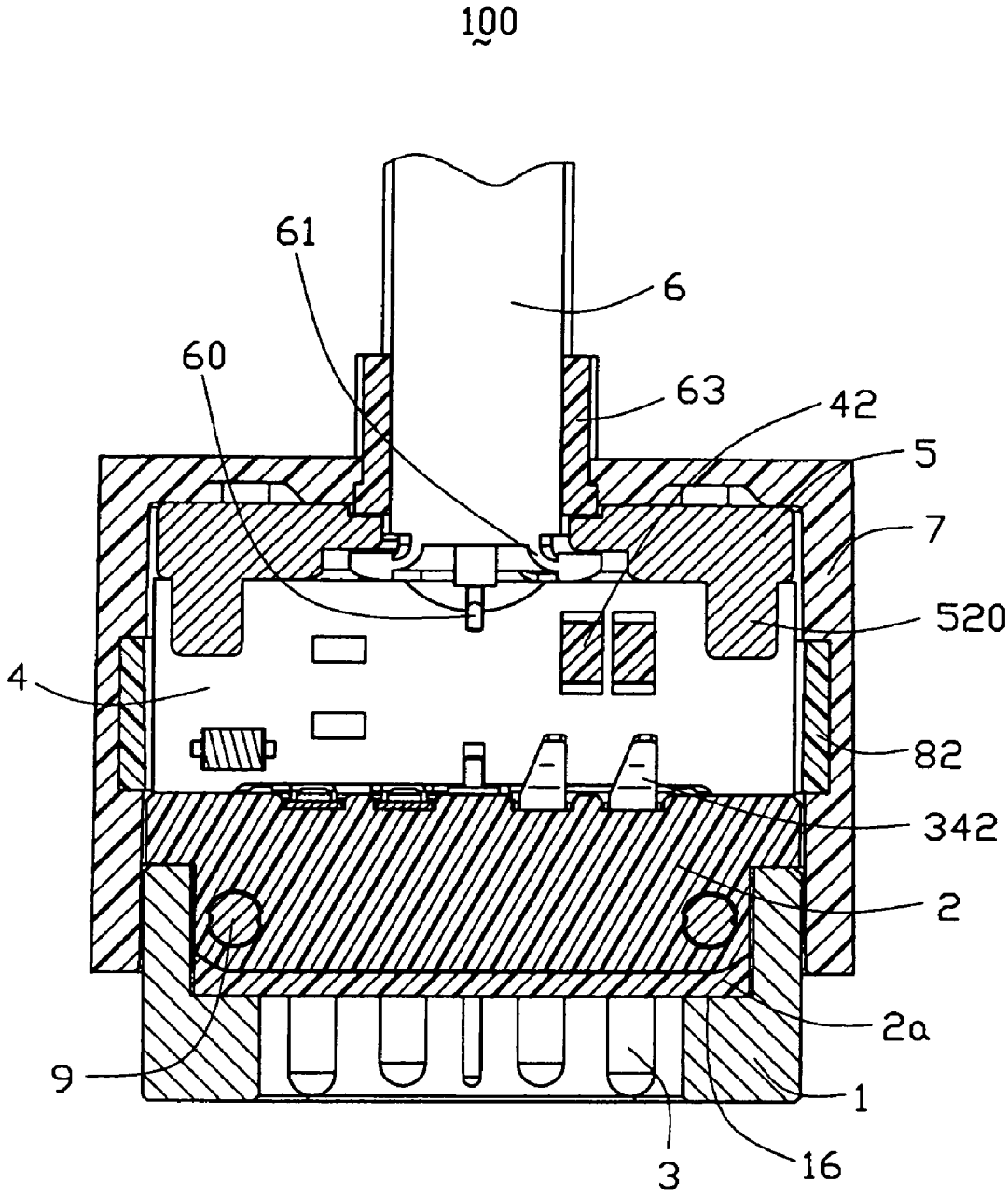
Figure 9:
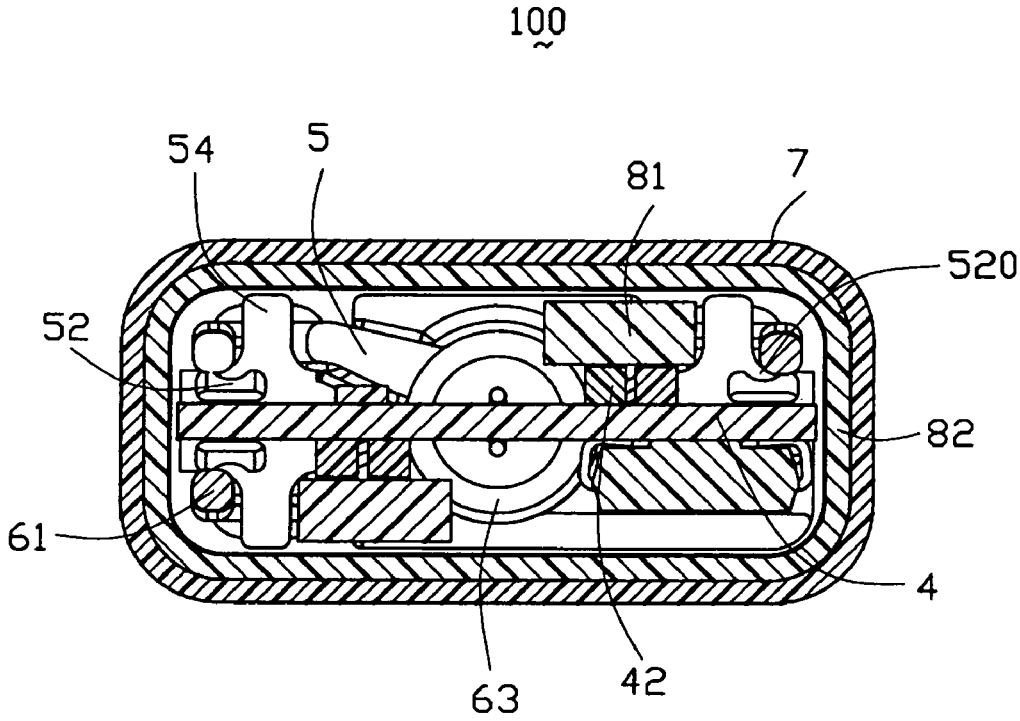
Figure 10:
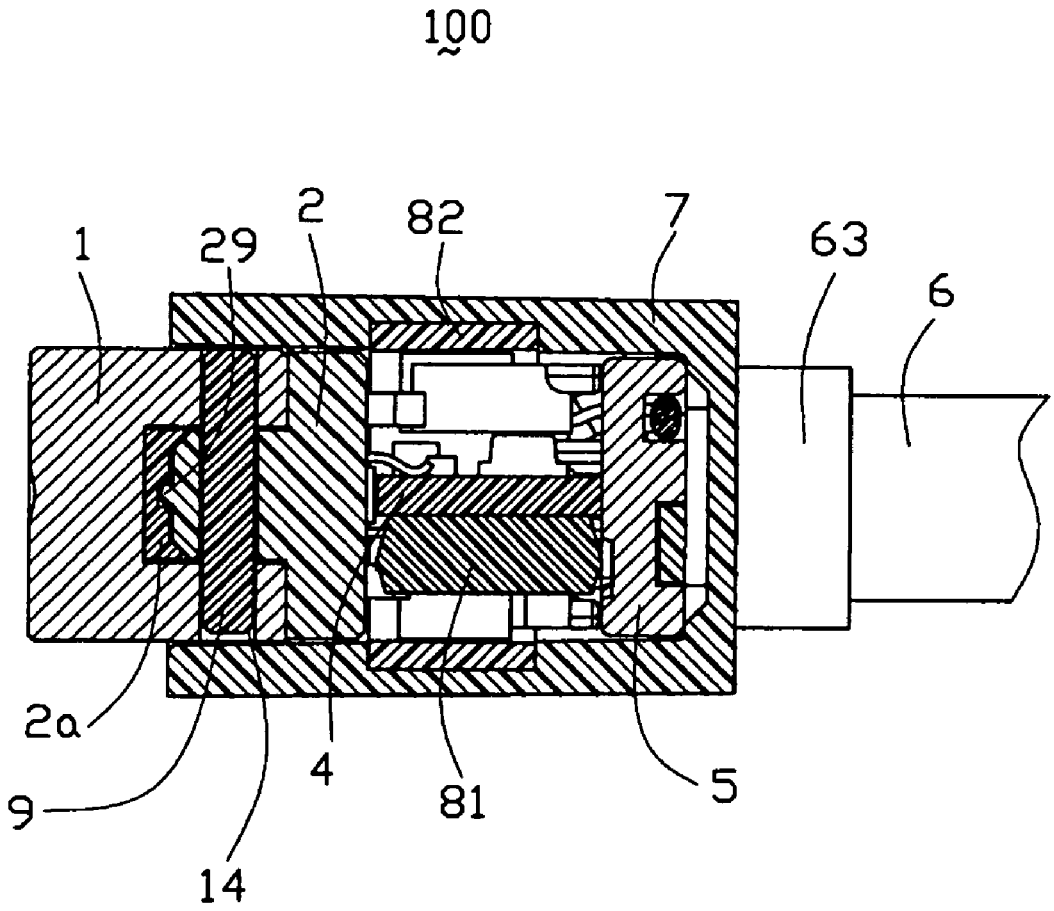

The front and rear covers 1, 7 are respectively assembled to the housing 2. The front cover 1 is made from conductive material capable of being attracted by complementary connector. The front cover 1 defines an elliptical-shape front receiving cavity 10 recessed rearwardly from a front surface thereof for receiving complementary connector and a rectangular rear receiving passage 12 recessed forwardly from a rear surface thereof to communicate with the front receiving cavity 10 for receiving the housing 2. The receiving passage 12 has a large size along a lateral direction of the front cover 1 than that of the receiving cavity 10, thus, forming a pair of step portions 16 therebetween (FIG. 8). The front cover 1 also defines a pair of circular second engaging holes 14 respectively recessed from a top surface to opposite rear surface thereof and locating adjacent to the rear surface thereof. The rear cover 7 is made from resin material and of rectangular shape.

The cable connector assembly 100 also comprises status indicator means (not labeled) made of transparent material or semitransparent material and comprising a pair of first light pipes 81 respectively overlapping the pair of LEDs 42 for spreading the light emitted by the LEDs 42 outwardly, and a pair of second light pipes 82 aligned with corresponding first light pipes 81 in a vertical direction and assembled to the rear cover 7 to spread the light permeated by the first light pipes 81 outwardly for indicating the normal status of the cable connector assembly 100. Each first light pipe 81 comprises a first body section 810 and a pair of engaging sections 812 respectively extending forwardly from the first body section 810. In addition, each engaging section 812 forms a pair of ribs 816 on opposite upper and lower surfaces thereof. The first body section 810 forms a first section 8101 aligning with corresponding LED 42 and a second section 8102 aligning with corresponding structure of the second light pipe 82. The second light pipe 82 is molded or injected from transparent or semitransparent material and comprises a belt-shape second body section 820 and a pair of post-shape positioning sections 822 extending outwardly from a center of the upper wall and the lower wall of the second body section 820.

The cable connector assembly 100 is further equipped with a cosmetic member **2*a* assembled to the housing 2 for cosmeticize the visual effect of the cable connector assembly 100. The cosmetic element 2*a* is of ellipse-shape and defines four first channels 25 and a second channel 26 corresponding to the first receiving passages 23 and the second receiving passage 24 of the housing 2 with dimensions corresponding to the diameters of the contacting portions 37 of the contacts 3. An entranceway 27 is recessed forwardly from a rear surface of the cosmetic element 2*a*, thus, forming an inner front face 270. A plurality of different-size passageways 28 recess forwardly from the inner front face 270 to communicate with corresponding first and second channels 25, 26 with dimensions corresponding to the diameters of the engaging sections 350 of the contacts 3. A pair of positioning recesses 272 also recesses forwardly from the inner front face 270 and locates at opposite sides of the cosmetic element 2*a*. Corresponding to the structures of the cosmetic element 2*a*, a front end of the tongue portion 22 is tapered to form a slant edge along outer periphery thereof for facilitating the assembly of the cosmetic element 2*a* and received in the entranceway 27**.

Figure 5:
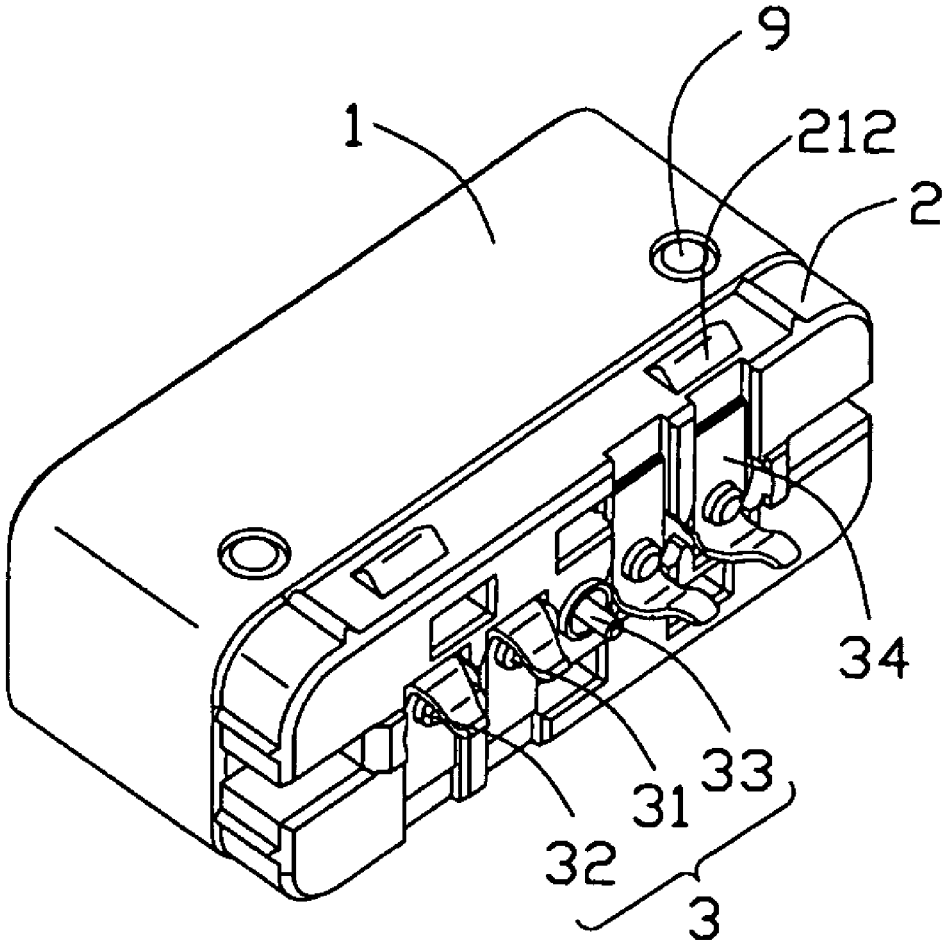
FIG. 5 is a partially assembled view of the cable connector assembly shown in FIG. 2.
Figure 6:
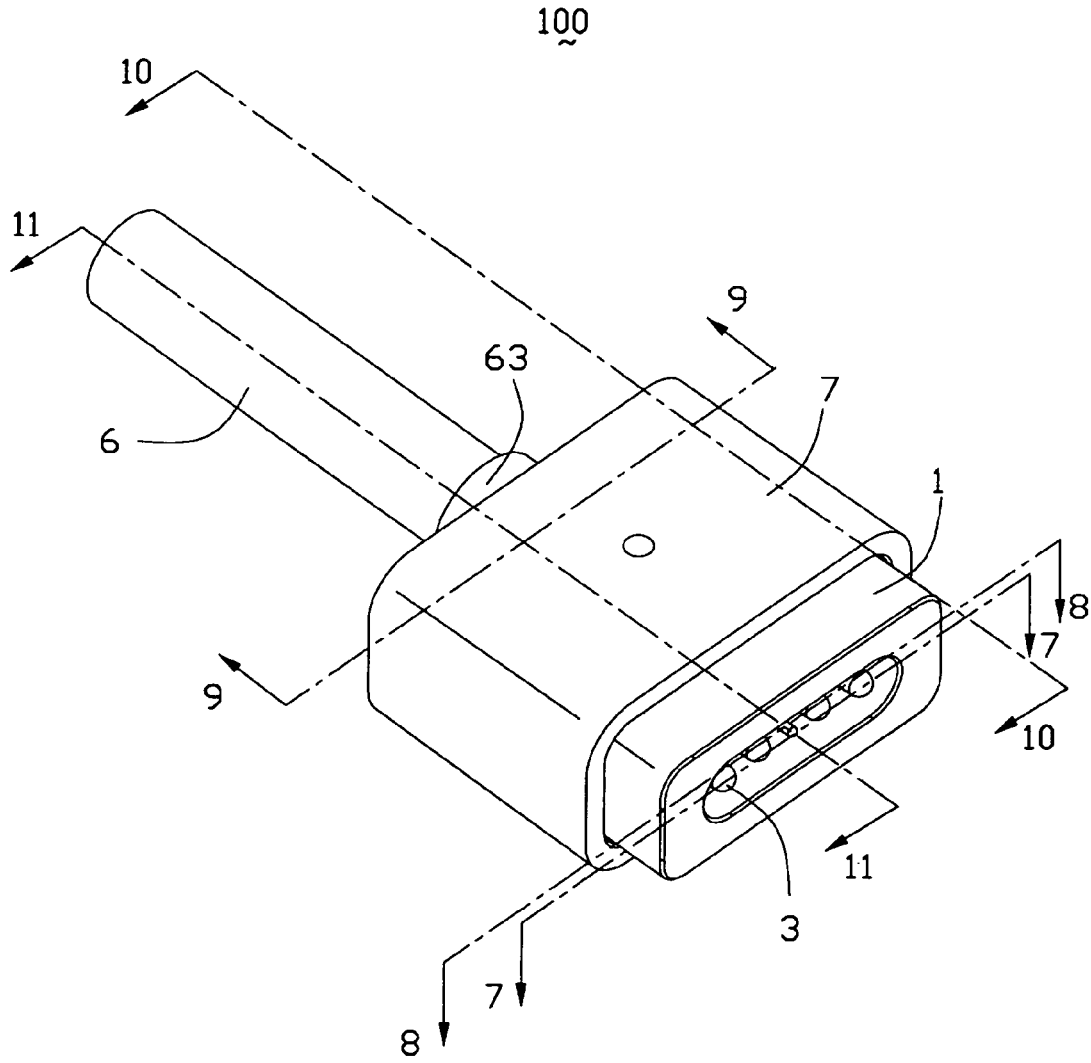
FIG. 6 is an assembled view of the connector assembly of FIG. 1.
Figure 7:
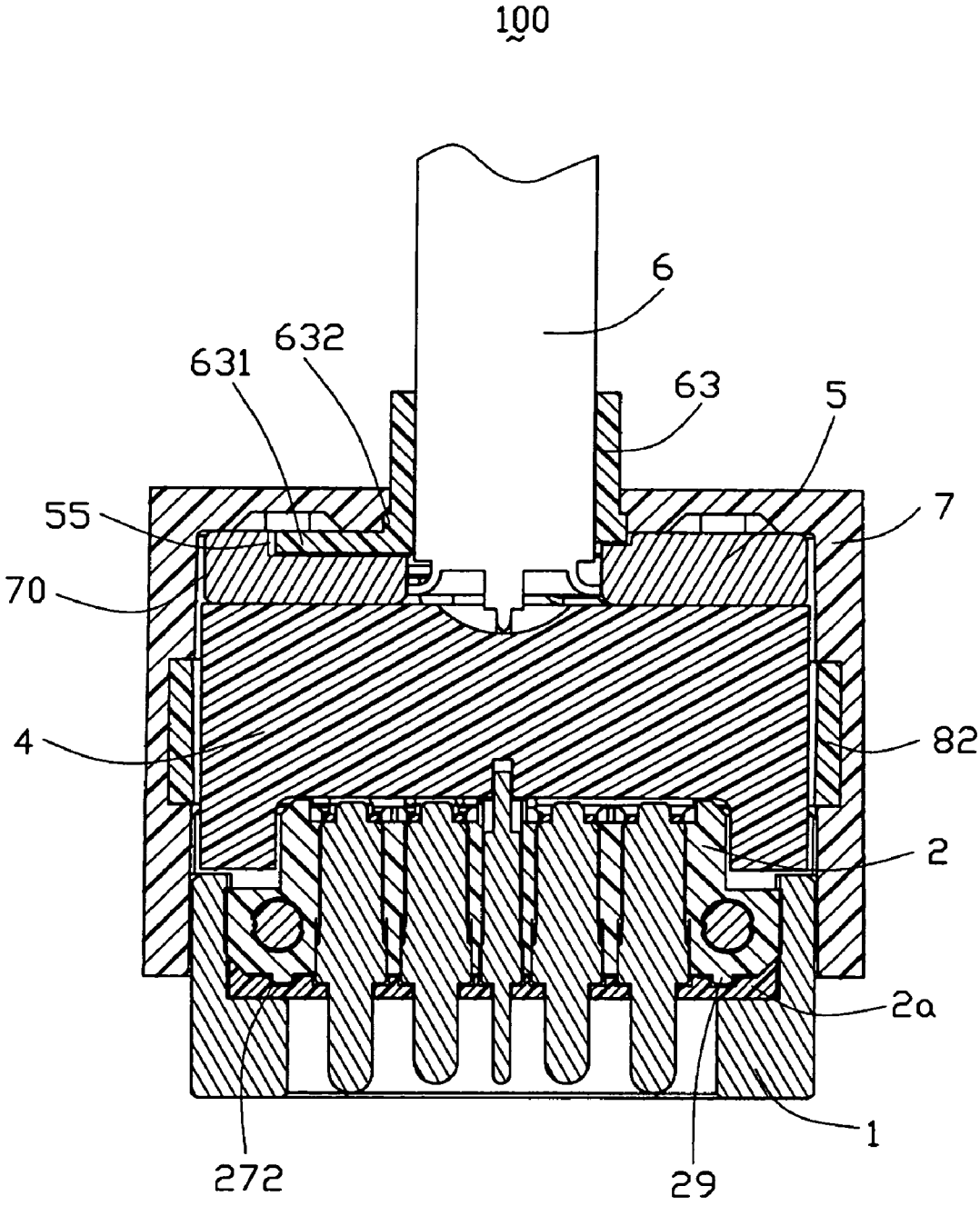
FIGS. 7-11 are cross-section views taken along lines 7-7 to 11-11 of FIG. 6.
Figure 11:
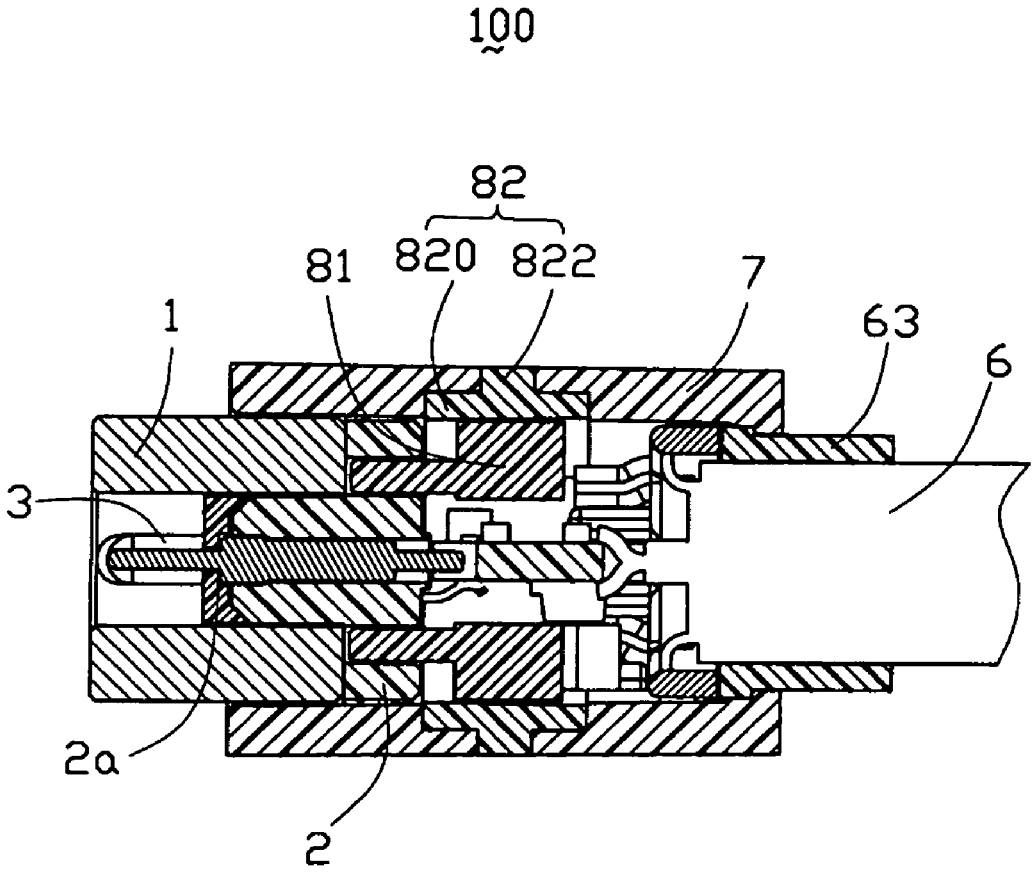

Referring to FIGS. 5-6 in conjunction with FIGS. 7-8 and 11, in assembly, the conductive contacts 3 are assembled to the housing 2 with the media portions 35 of the power contacts 31, ground contacts 32 and the detect contact 33 respectively received in corresponding first and second receiving passages 23, 24, the engaging sections 350 and the contacting portions 37 exposed beyond the front surface of the housing 2.

The end portions 36 of the power and ground contacts 31, 32 are respectively received in the first and second recesses 215, 216 and extend no longer than the rear surface of the housing 2, while, the end portion 36 of the detect contact 33 extends beyond the rear surface of the housing 2. The conductive elements 34 are respectively assembled to the housing 2 and the power and ground contacts 31, 32 with the connecting portions 340 received in corresponding first and second recesses 215, 216 of the housing 2 and corresponding end portions 36 of the power and ground contacts 31, 32 protruding through the receiving openings 344 and soldered with the connecting portions 340. Thus, the conductive elements 34 form electrical connection with corresponding power and ground contacts 31, 32.

The cosmetic element 2*a* is assembled to the housing 2 and the contacts 3. The pair of positioning protrusions 29 is respectively received in the positioning recesses 272 of the cosmetic element 2*a* for positioning the right position of the cosmetic element 2*a* and the front edge of the tongue portion 22 is received in the entranceway 27. After the cosmetic element 2*a* is assembled to the housing 2 and the contacts 3, the portions of the engaging sections 350 exposed outside of the housing 2 and the contacting portions 37 of the contact 3 are respectively received in the passageways 28 and the first and second channels 25, 26, thus, the front visual effect is improved.

Then referring to FIGS. 3-5 in conjunction with FIGS. 7-8 and 10-11, the front cover 1 is assembled to the housing 2 via a pair of pins 9. The tongue portion 22 with the cosmetic element 2*a* is firstly inserted into the receiving passage 12 of the front cover 1 until the front surface of the cosmetic element 2*a* abuts against the step portions 16 of the front cover 1 and the base portion 21 abuts against a rear surface of the front cover 1. Thus, the tongue portion 22 is frictionally received in the receiving passage 12 of the front cover 1 by means of the pair of second friction ribs 220. Furthermore, the contacting portions 37 are exposed in the receiving cavity 10 with tip ends of the ground contacts 32 substantially coplanar with a front surface of the front cover 1. The pair of first engaging holes 222 respectively align with the pair of second engaging holes 14 of the front cover 1 in the vertical direction, thus, the pair of pins 9 respectively inserts through the second engaging holes 14 and the first engaging holes 222 to position the front cover 1 relative to the housing 2. Of course, the engagement between the front cover 1 and the housing 2 also can be realized by other means, such as using glue, latch means et al.

Then, referring to FIGS. 1-2 in conjunction with FIGS. 7-8, the circuit board 4 is assembled to the housing 2 and electrically connects with the conductive elements 34 and the end portion 36 of the detect contact 33 for forming electrical connection with the contacts 3. The pair of stretching arms 400 is respectively received in the second slots 213 with the guidance of the pair of tapered protrusions 214. The two pairs of opposite oriented curved tail portions 342 are respectively soldered to corresponding traces on opposite upper and lower surfaces of the circuit board 4 to sandwich the circuit board 4 therebetween and form electrical connection with the circuit board 4. The end portion 36 of the detect contact 33 is received in a slit 402 rearward extending from a middle of a front edge of the circuit board 4 to directly electrically connect with the pair of LEDs 42.

Now referring to FIGS. 1-2 in conjunction with FIGS. 6-8, the pair of first light pipes 81 are respectively assembled to the housing 2 with the engaging sections 812 respectively frictionally received in the first slots 211 of the housing 2 via the ribs 816 formed thereon. Therefore, the first body sections 810 of the first light pipes 81 are respectively locate above corresponding LEDs 42 of the circuit board 4 for spreading the light emitting from the LEDs 42 outwardly.

Now referring to FIGS. 1-2 in conjunction with FIGS. 7-11, the cable 6 is firstly assembled to the strain relief member 5 then assembled to the circuit board 4 together with the strain relief member 5. The inner conductor 60 protrudes through the through hole 500 of the strain relief member 5, and the three parts of the metal braiding layer 61 firstly wrap to the routing portions 54 with forward portions located in the recess areas 520 of the jointing portions 52. Then, the forward portions of the metal braiding layer 61 are soldered with the jointing portions 52 to form electrical connection with the strain relief member 5. The strain relief member 5 is assembled to a rear end of the circuit board 4 with the jointing portions 52 thereof respectively soldered with opposite upper and lower surfaces of the circuit board 4 and the inner conductor 60 soldered with one of the upper and lower surfaces of the circuit board 4. Therefore, the electrical connection between the cable 6 and the circuit board 4 further with the contacts 3 is established. The stuffing member 63 is assembled to the cable 6 from a rear-to-front direction with the front end of the cable 6 received in the main portion 630, the first and second orientation portions 631, 633 respectively received in the first and second slots 55, 56 of the strain relief member 5.

Referring to FIGS. 1-2 in conjunction of FIGS. 6-11, the cable connector assembly 100 forms the second light pipe 82 and the rear cover 7 by means of injection or molding. Firstly, the second light pipe 82 is molded from transparent or semi-transparent material. Secondly, the rear cover 7 is molded over the second light pipe 82 to receive the second light pipe 82 therein. The rear cover 7 defines a receiving cavity 70 recessed rearwardly from a front surface thereof to communicate with a stepped receiving passage 72 in a rear edge thereof. The belt-shape body section 820 is received in a middle annular passage (not labeled) recessed outwardly from inner periphery of the rear cover 7 with the pair of positioning sections 822 respectively received in a pair of circular receiving holes 74 in upper and lower surfaces of the rear cover 7 to be exposed outside for indication. Then, the second light pipe 82 and the rear cover 7 together assembled to the assembly described above with a rear end of the front cover 1, the housing 2, the conductive elements 34, the circuit board 4, the first light pipes 81, the strain relief member 5, and the front end of the cable 6 received in the receiving cavity 70 of the rear cover 7. Corresponding to the protrusions 212 formed on upper and lower surfaces of the base portion 21 of the housing 2, the rear cover 7 forms two pairs of cutouts 700 to receive the protrusions 212 therein for increasing the retaining force between the housing 2 and the rear cover 7. The second sections 8102 of the first light pipes 81 respectively align with the positioning sections 822 of the second light pipes 82 to spread the light emitting from the LEDs 42 to outside for indication. In addition, the enlarged stuff portion 632 is received in the stepped receiving passage 72 with the main portion 630 exposed beyond the rear cover 7.

Once the cable connector assembly 100 mates with the complementary connector normally, the LEDs 42 emit light outwardly, and the light may permeate through the pair of first light pipes 81 then to the second light pipe 82 to indicate the user the normal status of the cable connector assembly 100. In the embodiment of the present invention, only the light pipes 81, 82 are made from transparent or semitransparent material, thus, cost is decreased. In addition, the light pipe 82 formed by means of molding also decreases cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

an insulative housing defining a mating port therein;

a plurality of contacts disposed in the housing;

a printed circuit board located behind the housing and electrically connected to the contacts;

an LED located upon the printed circuit board;

a cable connected to the printed circuit board;

a cover enclosing the printed circuit board and a front portion of the cable; and a first light pipe;

a second light pipe integrally formed in the cover and partially exposed to an exterior, and wherein the first light pipe transmit light from LED to the second light pipe to be spread to the exterior;

and wherein the printed circuit board is entirely received in the cover.

2. The assembly as claimed in claim 1, wherein the first light pipe defines two branches of which one is aligned with the LED and the other is aligned with the second light pipe.

3. The assembly as claimed in claim 1, wherein the second light pipe is formed by means of molding and molded with the cover.

4. The assembly as claimed in claim 1, further comprising a plurality of conductive elements electrically connecting with the contacts and the circuit board, and wherein each conductive element comprises a connecting portion soldered with corresponding contact and a tail portion substantially perpendicular to the connecting portion and soldered with the circuit board.

5. The cable connector assembly as claimed in claim 1, wherein the second light pipe surrounds the printed circuit board and the LEDs thereon.

6. The cable connector assembly as claimed in claim 1, wherein the second light pipe has a pair of tips exposed to an exterior, and wherein the second light pipe directly intimately contact the corresponding first light pipes to transmit light from LED toward the exterior through the tips.

7. The assembly as claimed in claim 1, wherein the first light pipe comprises a first body section aligning with the LED and an engaging section engaging with the insulative housing.

8. The assembly as claimed in claim 7, wherein the second light pipe comprises a second body section within the cover and a positioning section protruding through the cover.

9. The assembly as claimed in claim 8, wherein the first body section of the first light pipe comprises a first section aligning with the LED and a second section aligning with the positioning section of the second light pipe.

10. The assembly as claimed in claim 1, further comprising a front cover made of metal material and capable of being attracted by a complementary connector, and wherein the front cover is assembled to the housing with the contacts partially exposed therein.

11. The assembly as claimed in claim 10, wherein further comprising a cosmetic member assembled to front end of the housing received in the front cover for improving front view of the housing.

12. The assembly as claimed in claim 1, further comprising a strain relief member electrically connecting with the circuit board and the cable.

13. The assembly as claimed in claim 12, wherein cable comprises an inner conductor protruding through the strain relief member to directly electrically connect with the circuit board, and a metal braiding layer electrically connecting with the strain relief member.

14. The assembly as claimed in claim 13, wherein the strain relief member forms a jointing portion extending forwardly therefrom to be soldered with the circuit board and the metal braiding layer of the cable.

15. A cable connector assembly comprising:

an insulative housing defining a mating port therein;

a plurality of contacts disposed in the housing;

a printed circuit board located behind the housing and electrically connected to the contacts;

an LED located upon the printed circuit board;

a cable connected to the printed circuit board;

a cover enclosing the printed circuit board and a front portion of the cable; and a first light pipe;

a second light pipe integrally formed in the cover and exposed to an exterior, and wherein the first light pipe transmit light from LED to the second light pipe; wherein the first light pipe and the second light pipe are intimately engaged with each other sharing a same interface therebetween.

16. The cable connector assembly as claimed in claim 15, wherein the first light pipe comprises a first body section aligning with the LED and an engaging section engaging with the insulative housing, the second light pipe comprises a second body section within the cover and a positioning section protruding through the cover, and wherein the first body section of the first light pipe comprises a first section aligning with the LED and a second section aligning with the positioning section of the second light pipe.

17. A cable connector assembly comprising:

an insulative housing defining a mating port therein;

a plurality of contacts disposed in the housing;

a printed circuit board located behind the housing and electrically connected to the contacts;

an LED located upon the printed circuit board;

a cable connected to the printed circuit board;

a cover enclosing the printed circuit board and a front portion of the cable; and a first light pipe;

a second light pipe integrally formed in the cover and exposed to an exterior, and wherein the first light pipe transmit light from LED to the second light pipe; further comprising a strain relief member electrically connecting with the circuit board and the cable; wherein the cable comprises an inner conductor protruding through the strain relief member to directly electrically connect with the circuit board, and a metal braiding layer electrically connecting with the strain relief member.

* * * * *